United States Patent [19]

Thorp et al.

[11] Patent Number: 4,635,629

[45] Date of Patent: Jan. 13, 1987

[54] BREATHING APPARATUS

[75] Inventors: Peter Thorp, Rotherham; Roger E. W. Manley, Slough, both of England

[73] Assignee: Coal Industry (Patents) Limited, London, England

[21] Appl. No.: 774,714

[22] Filed: Oct. 4, 1985

Related U.S. Application Data

[63] Continuation of Ser. No. 718,414, Apr. 1, 1985, abandoned, which is a continuation of Ser. No. 476,907, Mar. 18, 1983, abandoned.

[30] Foreign Application Priority Data

Mar. 26, 1982 [GB] United Kingdom ..... 8208915

[51] Int. Cl.[4] ..... A62B 7/08

[52] U.S. Cl. ..... 128/202.26; 128/204.15; 128/205.12; 128/205.16; 128/205.17

[58] Field of Search ..... 128/204.15, 202.26, 128/205.12, 205.17, 205.16

[56] References Cited

U.S. PATENT DOCUMENTS

| | | | |
|---|---|---|---|
| 1,679,115 | 7/1928 | Drager | 128/205.16 |
| 3,000,191 | 9/1961 | Stark | 128/204.15 |
| 3,527,214 | 9/1970 | Rio et al. | 128/204.15 |
| 4,300,547 | 11/1981 | Pasternack | 128/204.15 |
| 4,301,792 | 11/1981 | Pasternack | 128/204.15 |
| 4,314,566 | 2/1982 | Kiwak | 128/204.15 |
| 4,364,384 | 12/1982 | Warncke et al. | 128/205.16 |

FOREIGN PATENT DOCUMENTS

| | | | |
|---|---|---|---|
| 665972 | 10/1965 | Belgium | 128/204.15 |
| 2519045 | 5/1976 | Fed. Rep. of Germany | 128/202.26 |
| 500560 | 2/1939 | United Kingdom . | |
| 733473 | 7/1955 | United Kingdom . | |
| 751033 | 6/1956 | United Kingdom . | |
| 887992 | 1/1962 | United Kingdom . | |
| 901334 | 7/1962 | United Kingdom . | |
| 1051054 | 12/1966 | United Kingdom . | |
| 1053102 | 12/1966 | United Kingdom . | |
| 1086806 | 10/1967 | United Kingdom . | |
| 1116763 | 6/1968 | United Kingdom . | |
| 1551510 | 8/1979 | United Kingdom . | |
| 1559743 | 1/1980 | United Kingdom . | |
| 2042345 | 9/1980 | United Kingdom . | |
| 2048080 | 12/1980 | United Kingdom . | |
| 212756 | 4/1968 | U.S.S.R. | 128/204.15 |

*Primary Examiner*—Henry J. Recla
*Attorney, Agent, or Firm*—James C. Wray

[57] ABSTRACT

Breathing apparatus of the closed- or semi-closed-circuit type includes a carbon dioxide absorber (8) which creates troublesome heat in operation. Apparatus giving acceptable breathing gas temperature incorporates an evaporative cooler unit (20), and a pump utilizing the diaphragm plate (15) of the breathing bag (3), the pump inducing an air flow over the evaporative cooler unit.

11 Claims, 6 Drawing Figures

BREATHING APPARATUS

This application is a continuation of application Ser. No. 718,414, filed Apr. 1, 1985, now abandoned, which was a continuation of application Ser. No. 476,907, filed Mar. 18, 1983, now abandoned.

This invention concerns improvements in breathing apparatus, more especially in breathing apparatus incorporating a carbon-dioxide absober. Carbon dioxide absorbers, predominantly containing soda-lime, are found in many different types of closed-circuit breathing apparatus and in semi-closed-circuit breathing apparatus such as the novel type illustrated and claimed in our published British Patent Application No. 2,064,335. The present invention has particular utility in respect of said semi-closed-circuit apparatus, but offers significant advantages when applied to all apparatus incorporating a carbon dioxide absorber.

The absorption of carbon dioxide in soda lime results in the emission of significant quantities of heat of reaction. This causes the heating of the gas being breathed by the user and although this may be advantageous in extremely cold environments such as in deep sea diving or at high altitudes, for most uses on land, including especially underground mines rescue, uncomfortably high breathing temperatures can be achieved. This effect is very much more noticeable as the ambient temperature and humidity rise, which reduces the amount of heat loss from the apparatus to the environment, and the user is also less able to lose body heat to his surroundings. The British Standard for breathing apparatus, BS 4667 Part 1 1974 Appendix D specifies that under the following conditions, the inhaled gas temperature shuld be not more than 40° C.:

| | |
|---|---|
| Frequency of breathing | 20 breaths per minute |
| Tidal volume | 2 liters |
| Minute volume | 40 liters per minute |
| Exhaled air | 5% $CO_2$ by volume, at 37° C., fully saturated with water vapour |
| Ambient | 30° C., at 85% to 90% relative humidity |

Taking as an example the apparatus of our said Patent Application operating with 10 liters/min of fresh oxygen, which involves the venting of about 8.5 liters/mm of exhalations, it can be calculated that some 900 calories are produced in the absorber each minute. To maintain the breathing gas temperature below 40° C., at least 700 calories have to be eliminated from the apparatus per minute. Conventionally, it has been assumed that this can be achieved by heat losses to the ambient supplemented by some form of cooler unit involving the latent heat of fusion of ice or other substance. To lose the required amount of heat by heat losses to the ambient alone would require approximately 5,500 sq. cm. of external surface area which has up to now proved impracticable.

It is to be understood that throughout the description and claims the use of "gas" or "oxygen" refers to a respirable gas or gas mixture, that is the apparatus can operate with oxygen or mixtures of oxygen with inert gases, for example oxygen-enriched air (such as air having a 50% oxygen content), oxygen-nitrogen and oxygen-helium mixtures, preferably those in which oxygen forms 50% or more of the mixture by volume.

The present inventors have realised that adequate cooling can at last be achieved by a combination of forced air flow and evaporative cooling. Accordingly, the present invention provides a breathing apparatus having a breathing circuit comprising a source of compressed breathable gas, a purifier capable of removing carbon dioxide from exhalations passed therethrough, a cooler unit having a surface adapted to retain a film of an evaporable liquid and a breathing bag assembly, whereby a quantity of ambient atmosphere is drawn from the ambient atmosphere and expelled across said surface of the cooler unit by the contraction and expansion of the breathing bag caused by the breathing of a wearer, and whereby the purified exhalations are cooled by passage through the cooler unit.

The invention uses the movement of the breathing bag found in all closed circuit and semi-closed-circuit apparatus to displace ambient atmosphere over the cooler. If the breathing bag is mounted in a housing so that the movement of the bag displaces a reasonable proportion of its internal volume, a simple pump can result, which may be easily made more positive using valves. Although the breathing bag may be a bladder, it is preferred that the bag has a displaceable diaphragm which may be of metal or like material, and a positive pressure apparatus may be achieved if the diaphragm is spring-loaded or otherwise biased to achieve a positive pressure with respect to ambient at all parts of the breathing cycle. Such a breathing bag is especially preferred since the diaphragm acts as a piston in the housing and gives a good pumping effect. This itself will cause no significant increase in breathing resistance. Advantageously, the path of the quantity of ambient atmosphere includes passage over the source of compressed breathable gas, which source cools because of adiabatic expansion, before the quantity is expelled over the surface of the cooler unit.

The evaporative cooler unit preferably uses an area of wettable fabric of natural or, preferably, synthetic fibre, of woven or non-woven construction and such fabrics are readily available and may be attached in a variety of ways to the surface of the cooler unit. The fabric may be wetted by any suitable liquid capable of evaporating at the temperatures of operation, which is non-toxic and non-inflammable under the ambient conditions, and which has an adequate heat of evaporation. Water is a particularly preferred liquid, but under certain high ambient vapour pressures, may yield inadequate cooling, and other liquids may be more desirable. Alternative liquids including refrigerants may be provided for use under different conditions likely to be encountered. Preferably, a reservoir is used to replenish the film of evaporable liquid, and replenishment may be achieved by using a wicking or capillary effect from a reservoir or by dripping by gravity from a reservoir, although if there is likely to be considerable changes of orientation of the apparatus, a capillary feed may be more reliable. If water is used, 200 ml should be adequate to provide cooling for up to three hours. The amount of liquid may be topped up from time to time. The reservoir may be a simple container for the liquid, or conveniently may be a material of high liquid absorption properties such as a synthetic sponge. Liquid may also be supplied from the reservoir by a pump, which may be manually actuated or actuated by movement of the breathing bag; fluidic diodes actuated by the movement of the bag have been found to be useful.

The cooler unit may include a channel for the passage of purified exhalations, which have been heated by passage through the purifier, and one wall of the channel may form a heat exchange surface, having on the side remote from the purifed exhalations, a surface adapted to retain a film of evaporable liquid, the surface being ventilated by movement of the breathing bag. The cooler unit preferably incorporates a first channel for passage of purified exhalations and a second channel for passage of the expelled quantity of ambient atmosphere, the second channel having at least one surface adapted to retain the film of evaporable liquid. Preferably, the first channel has means for increasing the path length of purified exhalations and/or for encouraging turbulent flow of purified exhalations therein, since heat transfer from the hot purified exhalations is thereby improved, and such means are suitably baffles or a metal wire packing, preferably in good thermal contact with the evaporating surface. The cooler unit may comprise a substantially rectangular unit mounted adjacent the purifier, with a central divider carrying baffles on both sides acting to increase the path length and also to conduct heat from the hot purified exhalations, and optionally from the mass of carbon dioxide absorbent in the purifier, to the section traversed by the expelled quantity of atmosphere. Suitably, as much as possible of the area of the second channel should be adapted to carry the evaporative liquid. The cooler unit may comprise a substantially cylindrical heat exchanger mounted inside a housing, the heat exchanger comprising a first channel and the second channel being defined between the walls of the heat exchanger and the housing. In a more preferred unit, a cylindrical heat exchanger comprises two concentric tubes defining between them an annular first channel, the second channel then including the central passage as well as the space between the outer wall and the housing. This more preferred unit advantageously has radial wires extending between the walls of the tubes in the annular first channel, and good heat transfer to inner and outer surfaces of the heat exchanger can be achieved; both inner and outer walls preferably are entirely covered with an absorbent fabric, in contact with a sponge-type liquid reservoir. Clearly, there should be no possiblity of contamination of gas in the breathing circuit with ambient atmosphere, and the gas paths are kept entirely separate.

To reduce heat gain to the breathing gas, it is preferred that the purifier is thermally isolated from other parts of the apparatus as much as possible, although to achieve a compact apparatus there will be constraints on the construction possible. A preferred apparatus has a housing incorporating breathing bag and pump for displacing air and mounted on the side away from the user a largely planar purifier, seperated from the housing and forming a space therebetween. Preferably, the purifier is also cooled by convection currents or by ventilation induced by the movement of the breathing bag. The breathing circuit will incorporate a relief valve, venting to atmosphere, and the apparatus may be designed to ensure that water vapour and excess liquid water is vented from the apparatus and it may be preferred to ensure that any liquid water is vented from such position that it supplements the feed of water to the evaporative cooler unit.

The invention will now be described with reference to the accompanying drawings, in which FIG. 1 is a general arrangement back view of a breathing apparatus according to the invention;

Figure 2:
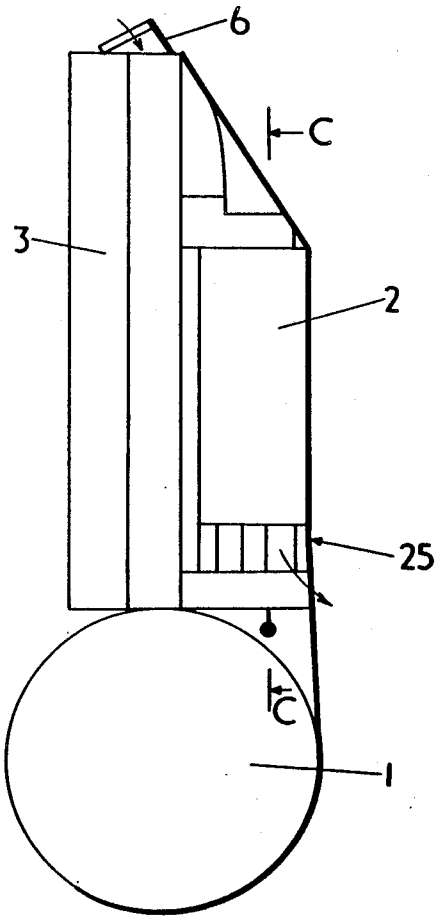
FIG. 2 is a side view of the apparatus of FIG. 1.
Figure 1:
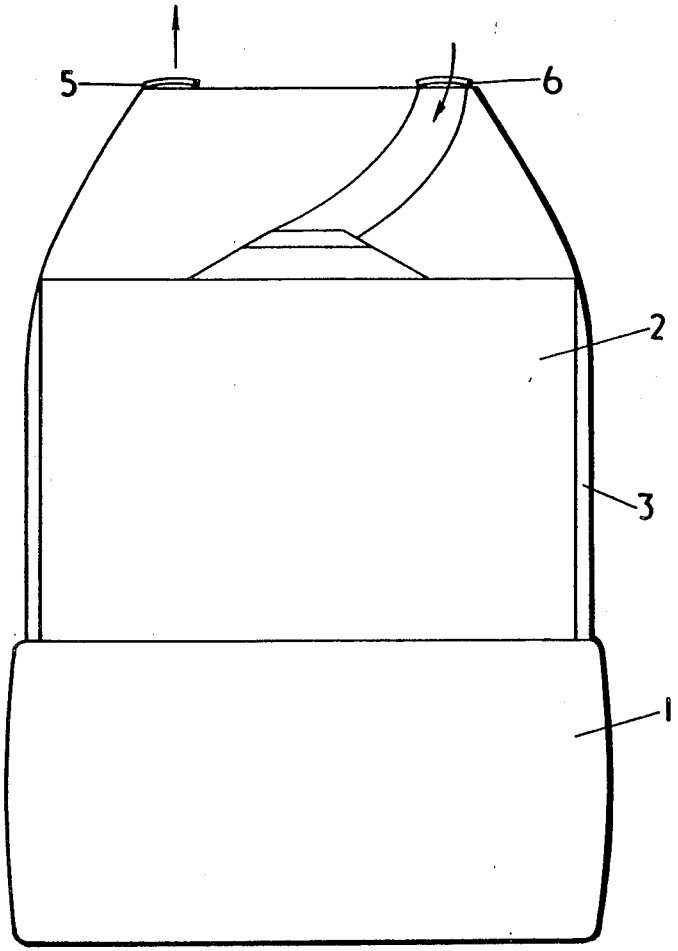
Figure 4:
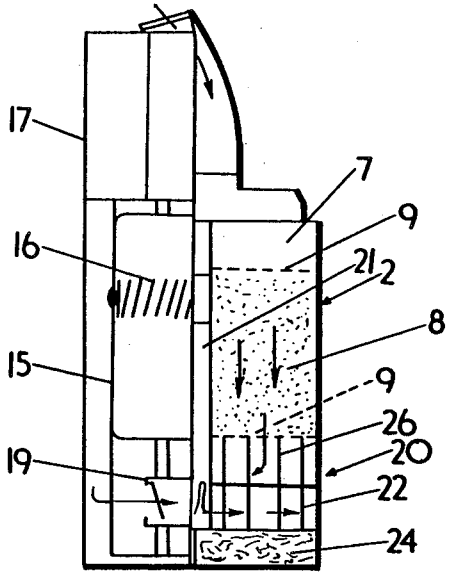
FIG. 4 is a section through the apparatus along line A—A of FIG. 3.
Figure 3:
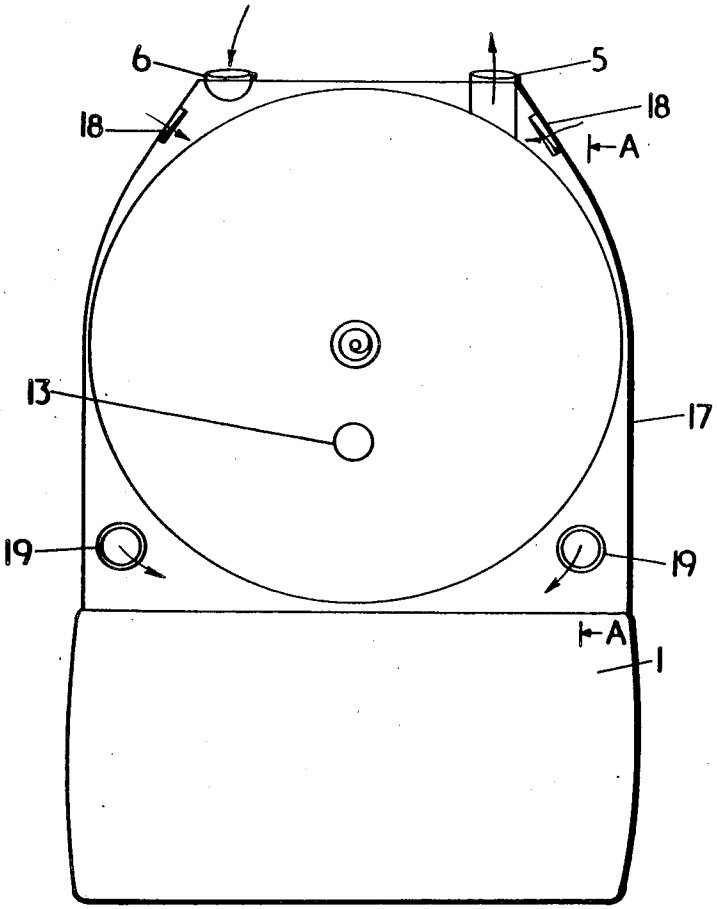
FIG. 3 is a front view of the apparatus of FIG. 1, with part of the apparatus removed.
Figure 6:
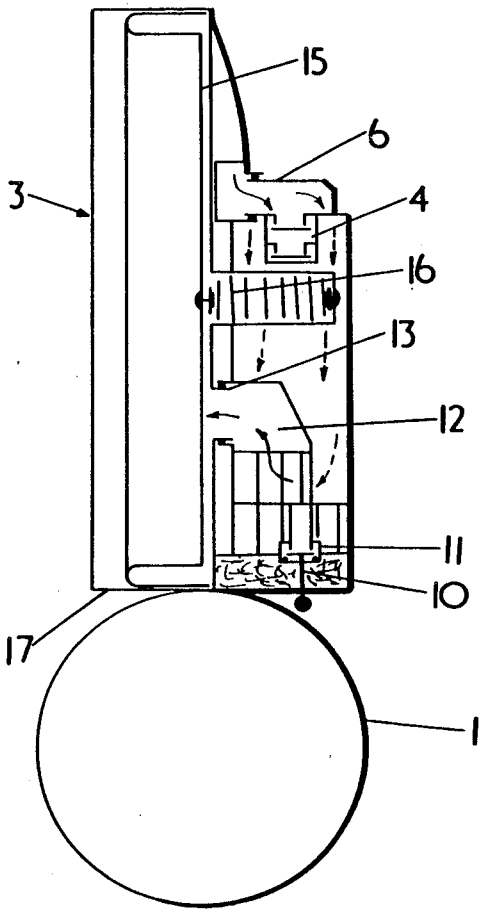
FIG. 6 is a section through the absorber of FIG. 5 along line B—B, including a breathing bag container.
Figure 5:
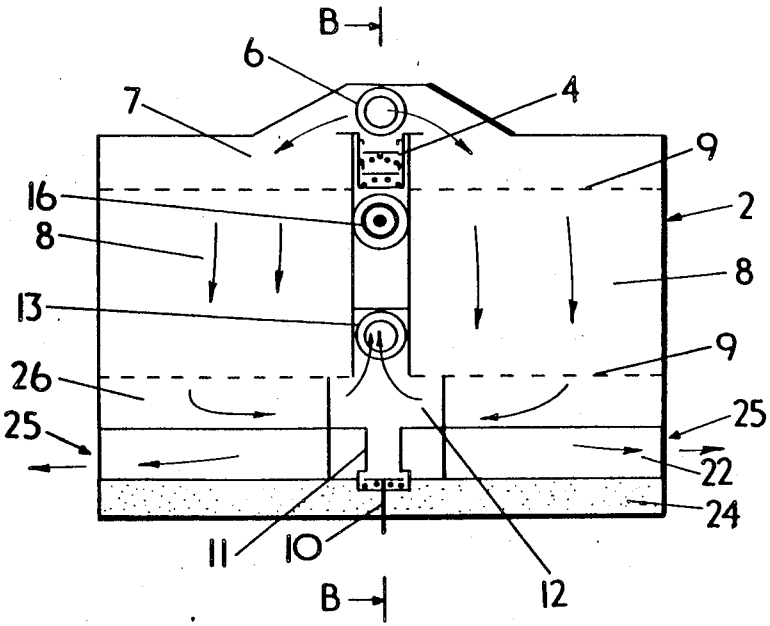
FIG. 5 is a vertical section through the absorber of the apparatus along line C—C of FIG. 2.

Referring initially to FIGS. 1, 2 and 5, the apparatus is in the form of a back pack, which includes a cylinder 1, containing compressed gas, a purifier section 2, and a breathing bag assembly section 3. The cylinder feeds fresh gas at a pre-determined volumetric flow, e.g. 6 or 12 liters oxygen/min. to the inhalation side of the apparatus, where it is admixed with recirculated, purified gas which is formed by part of the wearer's exhalations having passed through the purifier and having had carbon dioxide removed. The total feed of gas is appreciably in excess of that required by the wearer, and excess is vented to atmosphere through relief valve 4, positioned on the exhalation side of the apparatus. The gas is supplied to the wearer through a conventional flexible breathing tube (not shown) attached to pipe 5, and the apparatus may have a mouthpiece, face mask or other personal gas supply means for the wearer. The wearer's exhalations are taken by another conventional flexible breathing tube (not shown) to the exhalation side of the apparatus through pipe 6. The fresh gas may be fed into the breathing bag, for example adjacent the outlet from the breathing bag to the pipe 5, or into the pipe 5.

The part of the exhalations which is not vented to atmosphere passes into the purifier section 2 and is distributed by means of manifold 7 to twin masses 8, of soda lime absorber held between metal gauze pieces 9. A section 11, is provided for the collection of moisture; this can be released to the outside by manual operation of a vent 10. The purified gas leaving the purifier masses passes into manifold 12 and out of the purifier section through pipe 13. Pipe 13 connects with a circular breathing bag 14, which is formed by a resiliently mounted diaphragm 15, attached by means of a pre-tensioned spring 16 to the body of the breathing bag assembly. The spring ensures that the gas in the breathing circuit is always under positive pressure with respect to the surrounding atmosphere, even during inhalation, thus greatly reducing the chance of toxics leaking into the breathing circuit. As the wearer exhales, the breathing bag acts as a counter-lung, filling and expanding; similarly when the wearer inhales, the bag empties.

The breathing bag is mounted in a breathing bag housing 17, provided with simple inlet flap valves 18, connecting with the atmosphere, and similar outlet flap valves 19 connecting with an evaporative cooler unit 20. The movement of the breathing bag diaphragm 15 thus acts as to make the breathing bag assembly into a reciprocating pump, drawing ambient atmosphere in and expelling it into the cooler unit section 20. The purifier masses 8 are spaced apart from the breathing bag, providing a ventilated space 21. The evaporative cooler unit 20 has a number of baffles 22, covered with a fabric (not shown) which is a capillary fabric capable of distributing liquid over its surface. The baffles are in thermal contact with the metal baffles 26 over which the purified gas passes and are also in contact with the gauze 9. The baffles are also mounted so that they impinge upon a coolant reservoir in the form of a spongy mass 24, which is impregnated with an evaporative coolant liquid, conveniently water. The ambient atmosphere expelled over the baffles picks up sensible heat and liquid vapour, thus cooling the baffles by the appropriate amount of heat of evaporation, and leaves the cooler unit 20 to the outside atmosphere through outlets 25.

The combination of air movement and evaporative cooling is found to give adequate cooling, unattainable previously. Using British Standard conditions and 10 liters/min of fresh gas, about 35 liters of air per minute can be pumped through the cooling section, and the overall cooling effect can be calculated as follows.

With the external atmosphere at 30° C. and 90% relative humidity, and 10 l/min of fresh gas flow into the apparatus, 35 liters per min of air will be expelled across the cooler unit. If this expelled air is heated to 42° C., it will take up 125 cals/min of sensible heat.

Evaluating the cooling effect of evaporation, it can be estimated that the 35 l/min of air will pick up 0.85 grams/min of water, assuming saturation of the air leaving the apparatus, which corresponds to 459 cal/min of heat of evaporation. Thus the total heat removed by forced evaporative cooling is 584 cals/min. Considering that the heat generated within the apparatus that needs to be eliminated is 700 cals/min, only 116 cals/min further have to be removed to achieve the required cooling and required breathing gas temperature, and this can be achieved by radiation without difficulty since the required surface area of 760 sq. cm is less than the exposed surface of the purifier.

It is believed that the invention can be applied to any breathing apparatus in which heat production is a problem. It is particularly interesting to note that as the wearer breathes more frequently, for example in hard work or high stress situations, and produces more carbon dioxide (in turn leading to greater production of heat in the absorber) so the pumping action in the breathing bag container is increased, thus increasing the ventilation of the cooler unit and increasing the overall cooling effect.

We claim:

1. A breathing apparatus having a carbon dioxide absorbing-heat generating canister, cooling means of the type having paralell adjacent first and second flow passage means therethrough with a surface adapted to retain a film of evaporable liquid extending in said first passage means and in heat exchange relationship with said second passage means, a breathing bag, breathing gas recirculation means for passing exhausted breathing gases from a user through said carbon dioxide absorbing canister to purify the exhausted gases for inhalation, through said cooling means, through said breathing bag and back to the user, and means for inducing air flow over said cooler means, said means comprising:

a closed housing having inlet valve means for communicating ambient air to the interior of the housing and outlet valve means for communicating ambient air from within the housing through said second passage means of said cooler means; and said breathing bag being disposed within the housing for reciprocating movement, and having inlet means connected with said first passage of said cooler means for filling the breathing bag with replenished breathing gases and outlet means adapted to be connected to a user for emptying the breathing bag of breathing gases;

said inlet valve means being actuated by a pressure drop within the housing resulting from inward movement of the breathing bag due to emptying;

said outlet valve means being actuated by a pressure increase within the housing resulting from outward movement of the breathing bag within the housing due to filling, whereby as atmospheric air is pumped over said surface in said first flow passage means of said cooler means, sensible heat and liquid vapor is picked up thus cooling said surface thereby cooling breathing gases passing through said second flow passage means.

2. The apparatus of claim 1 further comprising:

biasing means, connected to the breathing bag, for positively biasing the breathing bag for inward movement.

3. The apparatus of claim 2, wherein the biasing means comprises a tension spring.

4. The apparatus of claim 1, wherein the inlet and outlet valve means are flap valves.

5. A source of compressed breathable gas having an outlet in communication with the breathing bag; and overpressure valve means communicating with said breathing gas recirculating means for relieving excess pressures therein.

6. The apparatus of claim 1 wherein the carbondioxide absorber means comprises a soda line absorber disposed within metal gauze, the absorber having an inlet end for receiving exhalations.

7. The apparatus of claim 1 wherein the second passage means of said cooler means comprises, a coolant reservoir and a plurality of baffles disposed within a first channel through which pass the purified exhalations, said baffles being in thermal contact with the outlet end of the carbon dioxide absorber means and said first passage means comprises a plurality of baffles disposed within a second channel through which passes the ambient air, one end of said baffles in said first channel being in thermal contact with one end of the baffles in said second channel and the opposite end of said baffles in said second channel impinging upon said coolant reservoir.

8. An apparatus as claimed in claim 1, wherein the breathing bag comprises a diaphragm mounted in said housing and biased to provide a pressure above ambient within the breathing gas recirculation means.

9. An apparatus as claimed in claim 1, wherein the means for retaining a film of evaporable liquid on the surface of the cooler comprises a fabric wettable by the liquid and a reservoir for liquid.

10. The apparatus of claim 1 wherein the evaporable liquid is water.

11. The apparatus of claim 1 wherein the surface of the cooler unit is covered with a wettable fabric in thermal contact therewith.

* * * * *